US005518046A

United States Patent [19]

Furukawa et al.

[11] Patent Number: 5,518,046

[45] Date of Patent: May 21, 1996

[54] METHOD FOR CHARGING LIQUIDS INTO CONTAINERS

[75] Inventors: Masahiko Furukawa; Satoshi Hori, both of Kanagawa, Japan

[73] Assignee: Fuji Photo Film Co., Ltd., Kanagawa, Japan

[21] Appl. No.: 262,869

[22] Filed: Jun. 21, 1994

[30] Foreign Application Priority Data

Jun. 21, 1993 [JP] Japan ..... 5-148785

[51] Int. Cl.[6] ..... B67C 3/02

[52] U.S. Cl. ..... 141/1; 141/67; 141/70; 141/114; 53/403; 53/457

[58] Field of Search ..... 141/1, 3, 10, 20, 141/63, 67, 70, 114, 92; 220/666; 53/457, 459, 564, 79, 403, 385.1; 215/382–384

[56] References Cited

U.S. PATENT DOCUMENTS

| | | | |
|---|---|---|---|
| 2,206,985 | 7/1940 | Vogt | 141/114 X |
| 3,301,293 | 1/1967 | Santelli | 220/666 |
| 3,453,799 | 7/1969 | Cloud et al. | 53/385.1 |
| 3,474,844 | 10/1969 | Lindstrom et al. | 220/666 |
| 3,520,337 | 7/1970 | Irland et al. | 141/3 |
| 3,531,908 | 10/1970 | Rausing et al. | 141/92 X |
| 3,973,603 | 8/1976 | Franz | 141/114 |
| 4,180,105 | 12/1979 | Harvey | 53/385.1 X |
| 4,417,607 | 11/1983 | Scholle et al. | 141/1 |
| 4,753,060 | 6/1988 | Furukawa | 53/459 |
| 5,269,428 | 12/1993 | Gilbert | 220/666 X |

*Primary Examiner*—J. Casimer Jacyna
*Attorney, Agent, or Firm*—Sughrue, Mion, Zinn, Macpeak & Seas

[57] ABSTRACT

A liquid is charged into a container through a liquid charging opening, which is formed at an upper end of the container. The container comprises a bottom for self-support, which is formed at a lower end of the container and causes the container to be supported by itself, and a pleated expansible part, which is formed at a middle region between the upper end and the lower end of the container and which expands or contracts vertically and causes the volume of the container to change due to at least a predetermined value of vertical load when the vertical load is given to the container. The container is fed into a liquid charging system, while the container is being supported by itself and the pleated expansible part is being contracted. Thereafter, when or before the liquid is charged by the liquid charging system into the container, at least the predetermined value of vertical load is given to the container, and the pleated expansible part is thereby caused to expand by a predetermined amount.

6 Claims, 8 Drawing Sheets

METHOD FOR CHARGING LIQUIDS INTO CONTAINERS

BACKGROUND OF THE INVENTION

1. Field of the Invention

This invention relates to a method for charging a liquid into a container through a liquid charging opening, which is formed at an upper end of the container.

2. Description of the Prior Art

In general, a container for containing a liquid therein is provided with a liquid charging opening, which is formed at an upper end of the container and through which the liquid is to be charged into the container. Those containers are roughly classified in accordance with the form or structure into (a) the containers, such as bottle-like containers constituted of synthetic resins, glass, metals, or the like, which are capable of supporting themselves and show little change in shape before they are charged with a liquid and after they are charged with the liquid, and (b) the containers, such as bag-like containers constituted of synthetic resin films, rubber, or the like, which are not capable of supporting themselves and show a large change in shape before they are charged with a liquid and after they are charged with the liquid.

In general, when a liquid is to be charged into a bottle-like container, the container, which is being supported by itself, is fed into a liquid charging means, and the liquid is charged by the liquid charging means into the container, which is being supported by itself. Also, in general, when a liquid is to be charged into a bag-like container, the container is fed into a liquid charging means while the upper end of the container is being held and the container is being thereby suspended. Thereafter, the liquid is charged by the liquid charging means into the container, which is being suspended.

With the operation for charging a liquid into the bottle-like container, the container can be fed into the liquid charging means, while the container is being supported by itself. Therefore, the working efficiency can be kept high. However, empty bag-like containers, which have not yet been charged with the liquid, occupy a large space as compared with the containers which have been charged with the liquid. Therefore, the efficiency, with which the empty containers are conveyed, and the efficiency, with which the empty containers are stored, cannot be kept high. Also, the equipment for conveying the empty containers into the liquid charging means must have a size corresponding to the large space, which is occupied by the empty containers, and therefore the equipment for conveying the empty containers cannot be kept small in size.

With the operation for charging a liquid into the bag-like container, the space occupied by empty containers can be kept small. However, when the container is fed into the liquid charging means, the container cannot be supported by itself. Therefore, a means and an operation for holding the upper end of the empty container and suspending the empty container are required when the empty container is fed into the liquid charging means. Also, the posture of the empty container will vary when the empty container is fed into the liquid charging means, and therefore a comparatively large conveyance space must be set by taking the variation in the posture of the empty container into consideration.

Further, in cases where a liquid is charged into a bottle-like container or a bag-like container, basically, a liquid charging amount, which is other than the specified amount corresponding to the size of the container, cannot be set for a single size of the container. Specifically, in cases where a liquid is charged into a bottle-like container, charging of the liquid in an amount smaller than the specified amount is not carried out generally, though possible, because the liquid charging volumetric efficiency becomes low. In cases where a liquid is charged into a bag-like container, if the liquid charging amount is smaller than the specified amount, the shape of the container after being charged with the liquid will not be stable. Therefore, such charging of the liquid in an amount smaller than the specified amount is not carried out in practice.

SUMMARY OF THE INVENTION

The primary object of the present invention is to provide a method for charging a liquid into a container, which eliminates the aforesaid problems of the conventional techniques and carries out liquid charging operations efficiently.

The object is accomplished by employing a self-supporting expansible container as the container to be charged with a liquid and carrying out a liquid charging operation such that the characteristics of the self-supporting expansible container may be utilized to the fullest.

Specifically, the present invention provides a method for charging a liquid into a container through a liquid charging opening, which is formed at an upper end of the container, wherein the container comprises a bottom for self-support, which is formed at a lower end of the container and causes the container to be supported by itself, and a pleated expansible part, which is formed at a middle region between the upper end and the lower end of the container and which expands or contracts vertically and causes the volume of the container to change due to at least a predetermined value of vertical load when the vertical load is given to the container, the method comprising the steps of:

i) feeding the container into a liquid charging means, while the container is being supported by itself and the pleated expansible part is being contracted, and ii) thereafter giving at least the predetermined value of vertical load to the container and thereby causing the pleated expansible part to expand by a predetermined amount when or before the liquid is charged by the liquid charging means into the container.

The container employed in the method for charging a liquid into a container in accordance with the present invention will hereinbelow be referred to as the self-supporting expansible container.

At least the predetermined value of vertical load may be given to the self-supporting expansible container with any timing after the container has been fed into the liquid charging means. Thus the vertical load may be given to the container when or before the liquid is charged by the liquid charging means into the container. For example, in cases where the load is given to the container before the liquid is charged into the container, the load may be given to the container with (a) a method, wherein an inert gas, or the like, is introduced into the container, and the internal pressure of the container is thereby increased, or (b) a method, wherein a vertical tensile load is given by a mechanical means from the exterior to the container. In cases where the load is given to the container when the liquid is charged into the container, the load may be given to the container with (a) a method, wherein the weight of the liquid having been charged into the container is utilized (i.e., the method wherein the liquid is charged into the container while the upper end of the container is being held and the container is being thereby suspended, and wherein the pleated expansible part is expanded by a predetermined amount by the weight of the liquid having been charged into the container, which weight serves as at least the predetermined value of vertical load), (b) a method, wherein the transfer pressure of the liquid charged into the container is utilized (i.e., the method wherein a liquid transfer pipe is located in close contact with the liquid charging opening formed at the upper end of the container, the liquid charging is carried out in this state, and the pleated expansible part is expanded by a predetermined amount by the transfer pressure of the charged liquid), or (c) a method, wherein a vertical tensile load is given by a mechanical means, or the like, from the exterior to the container (this method is effective particularly when the predetermined value of vertical load cannot be obtained only with the weight of the liquid).

As described above, with the method for charging a liquid into a container in accordance with the present invention, the self-supporting expansible container is fed into the liquid charging means while the container is being supported by itself. Therefore, the method for charging a liquid into a container in accordance with the present invention does not require a means and an operation for holding the upper end of the empty container and suspending the empty container as in the technique for charging the liquid into a bag-like container. Also, with the method for charging a liquid into a container in accordance with the present invention, the posture of the empty container does not vary when the empty container is fed into the liquid charging means. Therefore, it is not necessary to set a comparatively large conveyance space by taking the variation in the posture of the empty container into consideration.

Further, with the method for charging a liquid into a container in accordance with the present invention, the self-supporting expansible container is fed into the liquid charging means while the pleated expansible part is being contracted. Therefore, the space occupied by the empty container can be kept smaller than when the liquid is charged into a bottle-like container. Accordingly, the efficiency, with which the empty container is conveyed, and the efficiency, with which the empty container is stored, can be kept high. Also, the equipment for conveying the empty container into the liquid charging means can be kept small in size.

Moreover, with the method for charging a liquid into a container in accordance with the present invention, after the self-supporting expansible container has been fed into the liquid charging means, at least the predetermined value of vertical load is given to the container, and the pleated expansible part is thereby caused to expand by a predetermined amount when or before the liquid is charged by the liquid charging means into the container. Therefore, the volume of the container can be changed to a desired volume in accordance with the amount of the liquid charged into the container. Accordingly, different liquid charging amounts can be set for a single kind of container such that the liquid charging efficiency may not become low.

As described above, with the method for charging a liquid into a container in accordance with the present invention, the self-supporting expansible container is employed as the container to be charged with the liquid. Also, the operation for charging the liquid into the container is carried out by utilizing the advantages of the container in that it can support itself and can expand and contract vertically. In this manner, the aforesaid problems of the conventional techniques can be eliminated, and the liquid charging operations can be carried out efficiently.

DESCRIPTION OF THE PREFERRED EMBODIMENTS

The present invention will hereinbelow be described in further detail with reference to the accompanying drawings.

Figure 1:
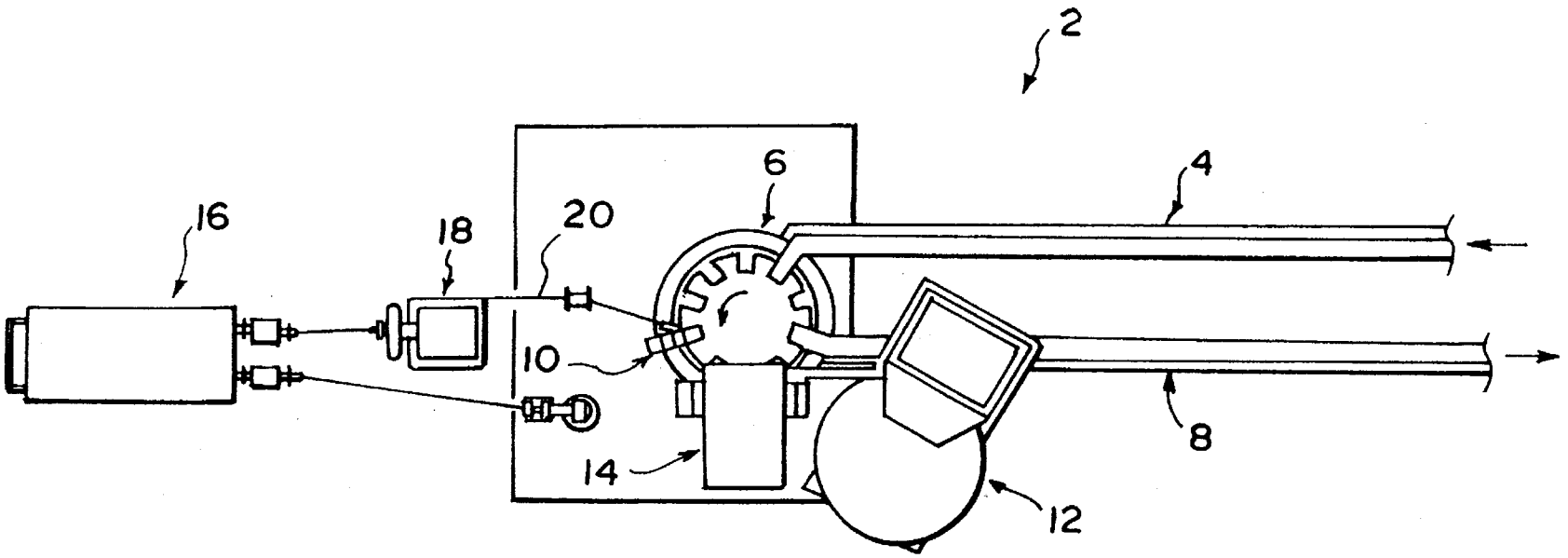
FIG. 1 is a plan view showing a liquid charging apparatus for carrying out an embodiment of the method for charging a liquid into a container in accordance with the present invention.
Figure 2:
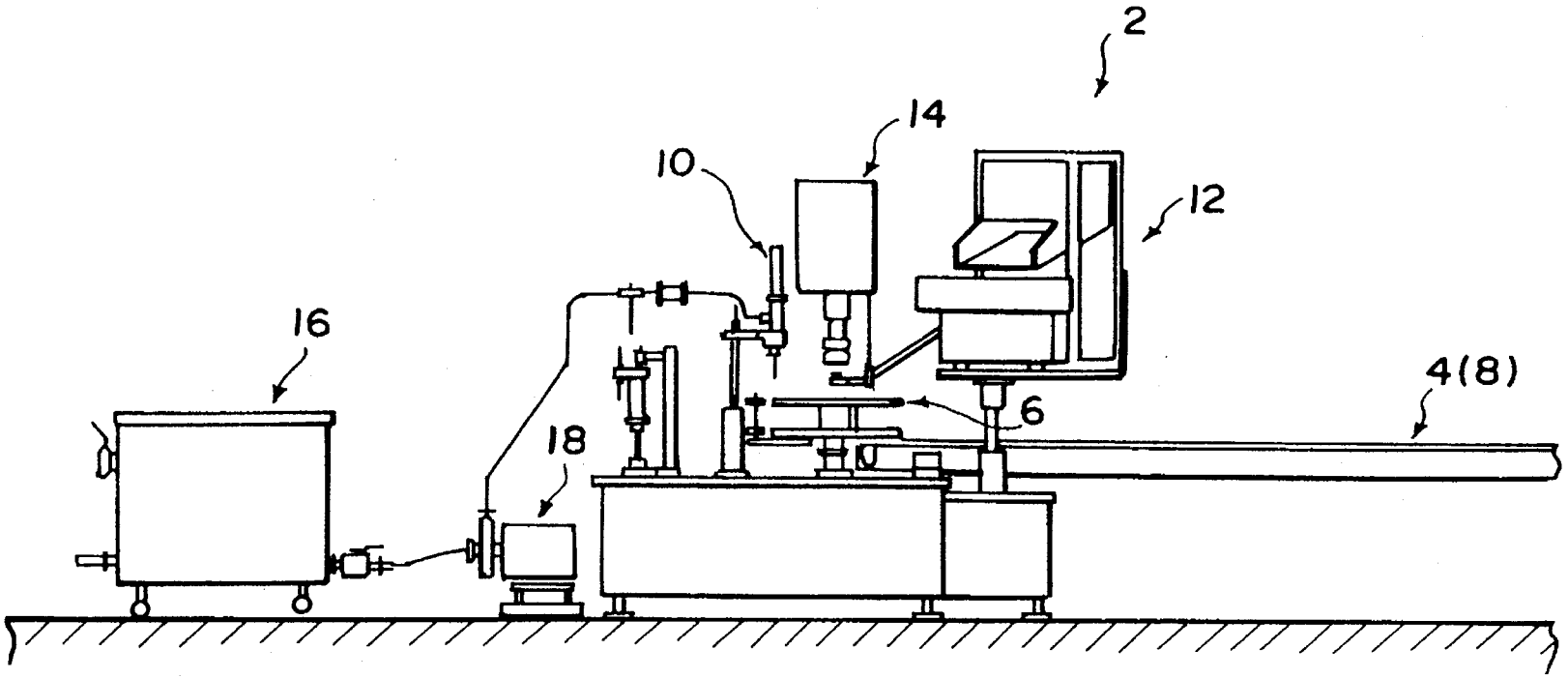
FIG. 2 is a side view showing the liquid charging apparatus of FIG. 1.

FIG. 1 is a plan view showing a liquid charging apparatus 2 for carrying out an embodiment of the method for charging a liquid into a container in accordance with the present invention. FIG. 2 is a side view showing the liquid charging apparatus 2.

Figure 4:
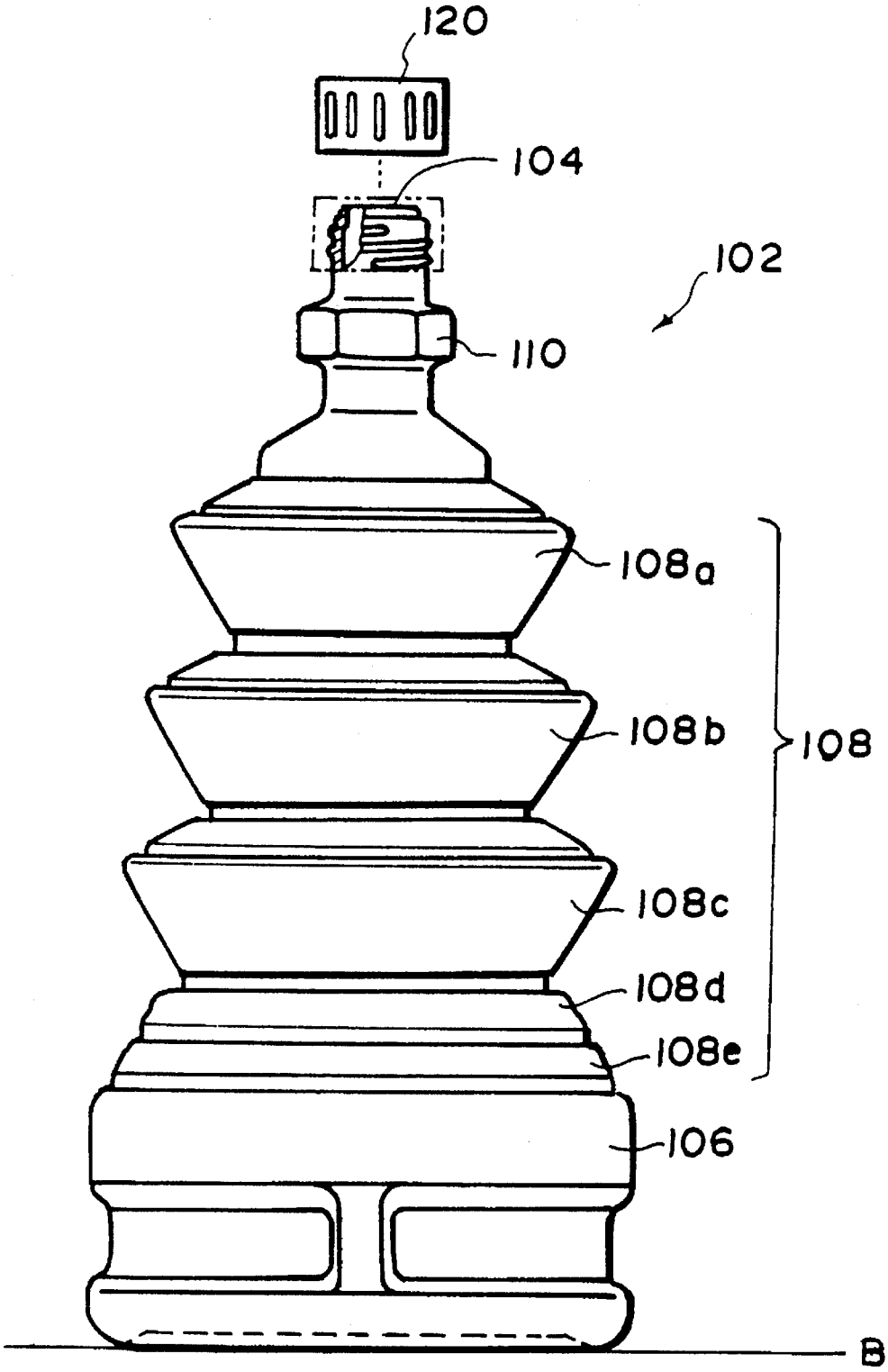
FIG. 4 is a side view showing a container, which is to be charged with a liquid in the embodiment of the method for charging a liquid into a container in accordance with the present invention and which is in its maximum expansion state.
Figure 5:
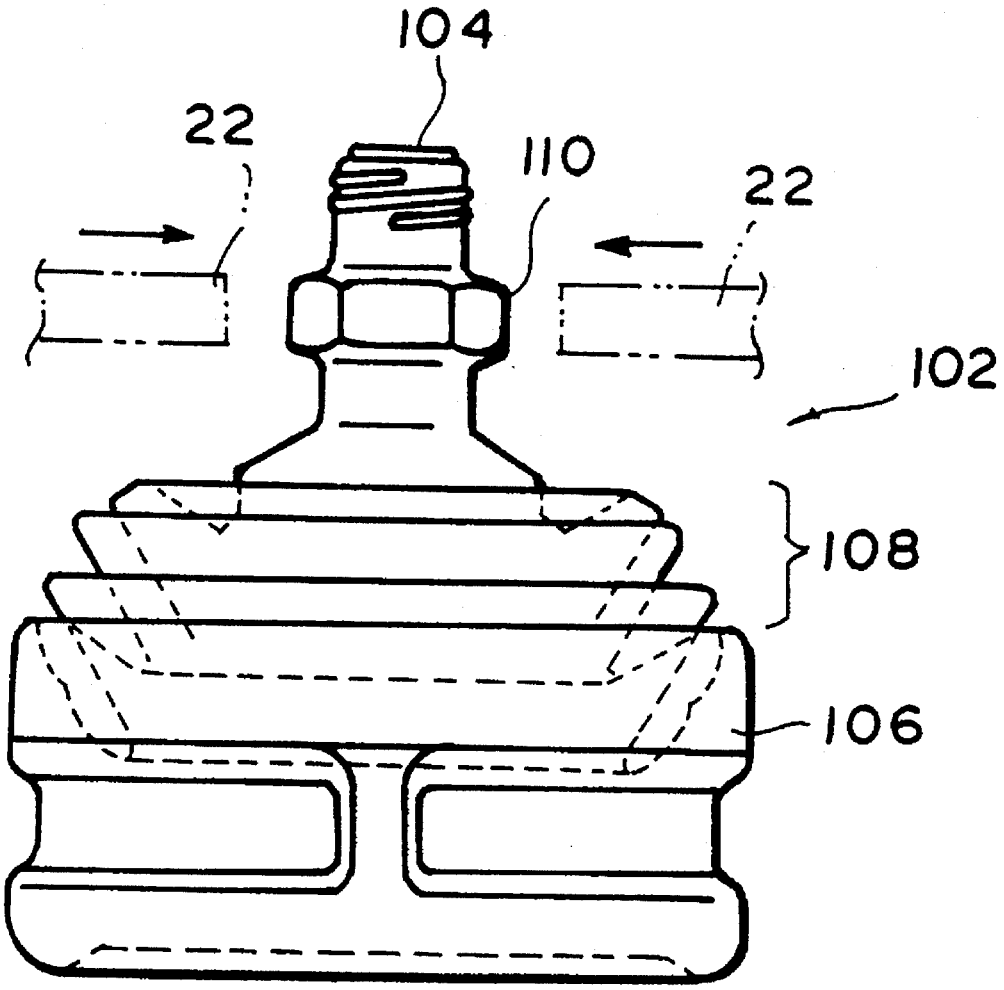
FIG. 5 is a side view showing a container, which is to be charged with a liquid in the embodiment of the method for charging a liquid into a container in accordance with the present invention and which is in its maximum contraction state.

In this embodiment, as illustrated in FIGS. 4 and 5, the container to be charged with a liquid by the liquid charging apparatus 2 has a specific structure. How a container 102 is constructed will be described hereinbelow.

As illustrated in FIG. 4, the container 102 is constituted of a synthetic resin such as polyethylene, copolymer of ethylene and vinylacetate, and polypropylene with a blow molding process. The container 102 comprises a liquid charging opening 104, which is formed at the upper end of the container 102 whose wall thickness is selected from the range of 0.5–4 mm or should preferably be selected from the range of 0.5–3 mm, a bottom for self-support 106, which is formed at the lower end of the container 102 and causes the container 102 to be supported by itself, and a pleated expansible part 108, which is formed at a middle region between the upper end and the lower end of the container 102. A cross sectional shape of the pleated expansible part 108 taken along a plane parallel to a bottom plane B should most preferably be a perfect circle. However, the shape may be oval or polygons having a circular arc at every corner, for example, a square, a rectangle, a hexagon or the like. Moreover, it is appropriate for a wall thickness of the pleated expansible part 108 and the bottom for self-support 106 to be from the range of 0.1–1.5 mm; preferably from the range of 0.2–0.7 mm; and most preferably from the range of 0.3 to 0.5 mm. A cap 120 is fitted to the liquid charging opening 104. Also, a chuck engaging portion 110 is formed in the vicinity of the liquid charging opening 104 at the upper end of the container 102. When the cap 120 is fitted to the liquid charging opening 104, the chuck engaging portion 110 is chucked such that the container 102 may not rotate.

The pleated expansible part 108 comprises a plurality of step-like portions. Specifically, a first step-like portion 108*a*, a second step-like portion 108*b*, and a third step-like portion 108*c*, which are protruded horizontally in a dog-legged shape, are formed in this order from the upper part of the container 102. Also, a fourth step-like portion 108*d* and a fifth step-like portion 108*e* are formed under the third step-like portion 108*c*. The shapes and the diameters of the respective step-like portions of the pleated expansible part 108 are designed such that, when a vertical compression load of not smaller than a predetermined value is given to the container 102, the fourth step-like portion 108*d* and the fifth step-like portion 108*e* may first collapse due to the load. When a larger compression load is then given to the container 102, the step-like portions collapse in the order of the third step-like portion 108*c*→the second step-like portion 108*b*→the first step-like portion 108*a*. Ultimately, as illustrated in FIG. 5, the container 102 is brought into the maximum contraction state, in which the height of the container 102 is contracted to approximately one half of the original height. Conversely, when a vertical tensile load of not smaller than a predetermined value is given to the container 102, which is in the maximum contraction state, the fourth step-like portion 108*d* and the fifth step-like portion 108*e* may first expand due to the load. When a larger tensile load is then given to the container 102, the step-like portions expand in the order of the third step-like portion 108*c*→the second step-like portion 108*b*→the first step-like portion 108*a*. Therefore, the container 102 returns to its original height shown in FIG. 4 and is brought into the maximum expansion state. In this manner, in this embodiment, the container, which can support itself and can expand or contract vertically, is employed as the container 102 to be charged with the liquid. For each of the step-like portions 108*a*, 108*b*, 108*c*, 108*d* and 108*e* of the pleated expansible part 108, it is appropriate for a diametrical ratio of the maximum diametrical part to the minimum diametrical part, that is, the maximum diametrical part to the upper minimum diametrical part of any step-like portion to be set to between 1.03 and 1.4 and preferably to between 1.1 and 1.2.

Also, in the adjoining step-like portions of the pleated expansible part 108, for example, a pair of the step-like portions 108*a* and 108*b* or a pair of the step-like portions 108*b* and 108*c*, or the like, a diametrical ratio of the maximum diametrical part is set to between 1.05 and 1.20 relative to a diameter of a step-like portion having a smaller diameter, for example, the step-like portion 108*a* in the case of the pair of the step-like portions 108*a* and 108*b*. It is appropriate for the number of step-like portions to be contained in the pleated expansible part 108 to be set to between 3 and 8 and preferably to between 4 and 6.

It is appropriate for the height of the container 102 in the maximum expansion state to be set to between 1.3 and 4.0 and preferably to between 1.5 and 3.0 relative to a diameter of the bottom for self-support 106.

It is appropriate for the bottom for self-support 106 to be set to between 40 and 200 mm and preferably to between 70 and 130 mm in view of the handling characteristics thereof.

In addition, in the pleated expansible part 108, a ratio of a wall thickness of the minimum diametrical part, or the maximum diametrical part, if necessary, to remaining parts other than the minimum or maximum diametrical part should preferably to set to between 0.6 and 1.0 provided that the wall thickness of the remaining part is set to 0.1.

Further, the container is designed in such a way that a predetermined value of vertical loads for expansion should be set to between 3 and 20 kgf/cm and more preferably to between 5 and 10 kgf/cm.

In one embodiment, the diameter of the bottom for self-support of the container 102 is 100 mm, the height of the container 102 in the maximum expansion state is 210 mm, and the height of the container 102 in the maximum contraction state is 112 mm. Therefore, when the state of the container 102 changes from the maximum expansion state to the maximum contraction state, the percentage of volume reduction of the container 102 is approximately 47% [=(210−112)÷210×100].

As illustrated in FIGS. 1 and 2, the liquid charging apparatus 2 is of the index table (rotary) type and comprises a feed-in conveyor 4 for conveying a plurality of empty containers 102, 102, . . . , each of which has the structure shown in FIGS. 4 and 5, one after another and leftwardly from the right side of FIG. 1. The liquid charging apparatus 2 also comprises an index table 6, which rotates intermittently at predetermined angle intervals and counter-clockwise in FIG. 1 and which thus intermittently feeds the containers 102, 102, . . . having been received from the feed-in conveyor 4. The index table 6 serves as the liquid charging means. The liquid charging apparatus 2 further comprises a feed-out conveyor 8 for conveying the containers 102, 102, . . . , which have been intermittently fed by the index table 6, rightwardly in FIG. 1.

A liquid charging device 10 and a capper 14 are located above the index table 6 of the liquid charging apparatus 2. The liquid charging device 10 charges a predetermined amount of the liquid into each container 102. The capper 14 fits a cap 120, which is shown in FIG. 4 and is supplied from a parts feeder 12, onto the container 102. The liquid charging device 10 is connected by a liquid transfer pipe 20 to an intermediate tank 16, which stores the liquid to be charged, and a liquid transfer pump 18, which pumps the liquid out of the intermediate tank 16 into the liquid charging device 10. Also, a chucking means 22 shown in FIG. 5 is located above the index table 6. The chucking means 22 chucks the chuck engaging portion 110 of the container 102.

Figure 3:
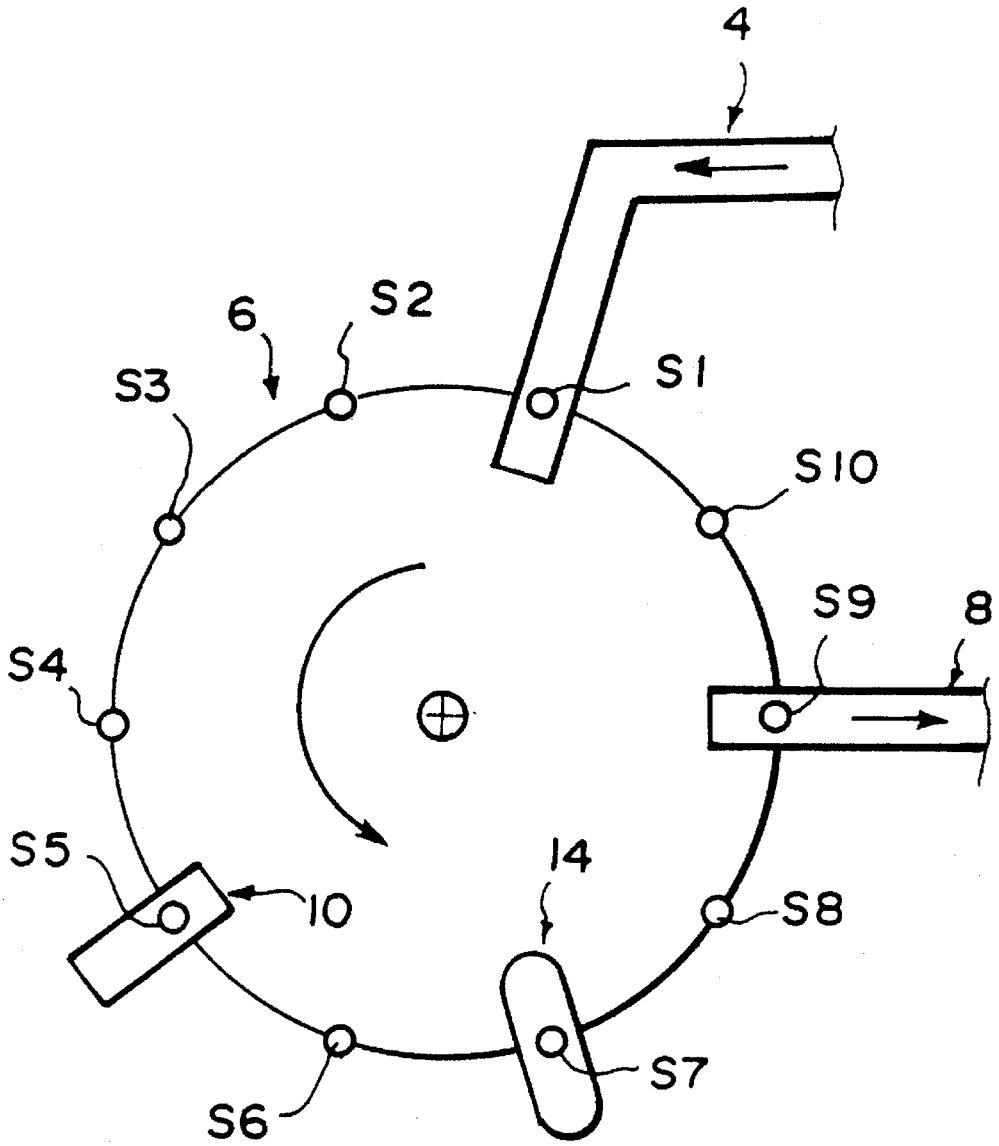
FIG. 3 is a plan view showing an index table in the liquid charging apparatus of FIG. 1.

As illustrated in FIG. 3, the index table 6 is provided with ten stations S1 through S10. The index table 6 rotates intermittently and keeps each container 102 stationary for a predetermined time at each station.

In this embodiment, the container 102 is formed by the blow molding process into the shape in the maximum expansion state. Thereafter, the container 102 is collapsed vertically into the maximum contraction state. The container 102 is placed in the maximum contraction state and in the self-supporting state on the feed-in conveyor 4 and conveyed by the feed-in conveyor 4 to a feed-in station S1 of the index table 6.

In the manner described above, the empty container 102 is conveyed by the feed-in conveyor 4 to the feed-in station S1. In the feed-in station S1, the chuck engaging portion 110 of the container 102 is chucked by the chucking means 22 shown in FIG. 5. In this manner, the container 102 is suspended by the chucking means 22 and intermittently fed on the index table 6. The container 102 passes through idle stations S2, S3, and S4 and is thereafter fed into a liquid charging station S5.

The liquid charging device 10 is located in the liquid charging station S5, and the specified amount of the liquid is charged by the liquid charging device 10 into the container 102. The liquid is charged into the container 102, while the chuck engaging portion 110 of the container 102 is being chucked and the container 102 is thus being suspended.

Therefore, the vertical tensile load is given by the weight of the charged liquid to the pleated expansible part 108. When the amount of the liquid charged reaches a certain value, the fourth step-like portion 108*d* and the fifth step-like portion 108*e* expand. When the amount of the liquid charged increases even further, the step-like portions expand in the order of the third step-like portion 108*c*, the second step-like portion 108*b*, and the first step-like portion 108*a* in accordance with the amount of the liquid charged. How many step-like portions expand is determined by the specified amount of the liquid charged into the container 102.

The container 102, which has been charged with the specified amount of the liquid in the liquid charging station S5, passes through an idle station S6 and is then fed into a capping station S7.

In the capping station S7, a cap 120 is fitted by the capper 12 onto the container 102. Thereafter, the container 102 passes through an idle station S8 and is conveyed into a feed-out station S9. In the feed-out station S9, the container 102 is transferred onto the feed-out conveyor 6, which conveys the container 102 out of the liquid charging apparatus 2. In this embodiment, an idle station S10 is located between the feed-in station S1 and the feed-out station S9.

As described above, in this embodiment, the self-supporting expansible container 102 is employed as the container to be charged with the liquid. Also, the operation for charging the liquid into the container is carried out by utilizing the advantages of the container in that it can support itself and can expand and contract vertically. Therefore, the effects described below can be obtained.

Specifically, in this embodiment, the container 102 is fed to the index table 6 while the container 102 is being supported by itself. Therefore, this embodiment does not require a means and an operation for holding the upper end of the empty container and suspending the empty container as in the technique for charging the liquid into a bag-like container. Also, with this embodiment, the posture of the empty container does not vary when the empty container is fed to the index table 6. Therefore, it is not necessary to set a comparatively large conveyance space by taking the variation in the posture of the empty container into consideration.

Further, in this embodiment, the self-supporting expansible container 102 is fed to the index table 6 while the pleated expansible part 108 of the container 102 is being contracted. Therefore, the space occupied by the empty container can be kept smaller than when the liquid is charged into a bottle-like container. Accordingly, the efficiency, with which the empty container is conveyed, and the efficiency, with which the empty container is stored, can be kept high. Also, the equipment for conveying the empty container to the index table 6 can be kept small in size.

Moreover, in this embodiment, after the self-supporting expansible container 102 has been fed to the index table 6, the pleated expansible part 108 is caused to expand vertically by a predetermined amount due to the weight of the charged liquid when the liquid is charged by the liquid charging device 10 into the container 102. Therefore, the volume of the container can be changed to a desired volume in accordance with the amount of the liquid charged into the container. Accordingly, different liquid charging amounts can be set for a single size of container such that the liquid charging efficiency may not become low.

In the embodiment described above, in the feed-in station S1, the chuck engaging portion 110 of the container 102 is chucked by the chucking means 22 shown in FIG. 5, and the container 102 is thereby suspended. In this state, the container 102 is intermittently fed on the index table 6. Instead of being chucked in such a manner, the container 102 may be intermittently fed on the index table 6 while the container 102 is being supported by itself. In such cases, for example, the pleated expansible part 108 may be expanded vertically by a predetermined amount in the station S2, S3, or S4 prior to the liquid charging step. For this purpose, an inert gas such as nitrogen, or the like, may be introduced into the container 102, and the internal pressure of the container 102 may thereby be increased. Alternatively, a vertical tensile load may be given by a mechanical means from the exterior to the container 102. Thereafter, the liquid may be charged into the container 102, which has thus been expanded. As another alternative, when the liquid is being charged into the container 102 in the liquid charging station S5, a vertical tensile load may be given by a mechanical means from the exterior to the container 102, and the pleated expansible part 108 may thereby be expanded vertically by a predetermined amount. In such cases, the chuck engaging portion 110 of the container 102 is chucked in the capping station S7, and therefore it is necessary to provide a chucking means. The chucking means may also serve as the mechanical means described above.

Figure 6:
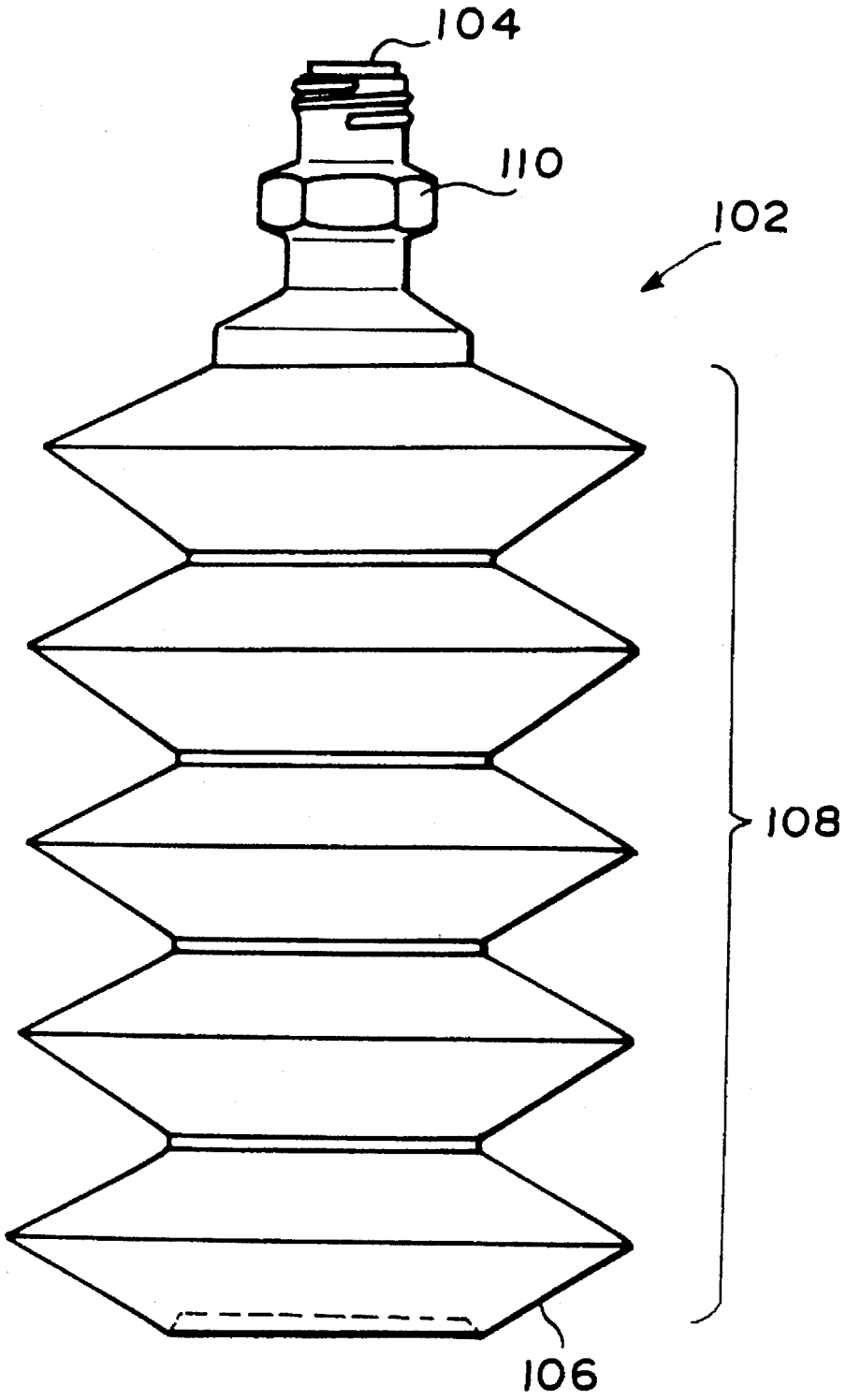
FIGS. 6, 7, and 8 are side views showing different examples of containers, which are in the maximum expansion state.
Figure 7:
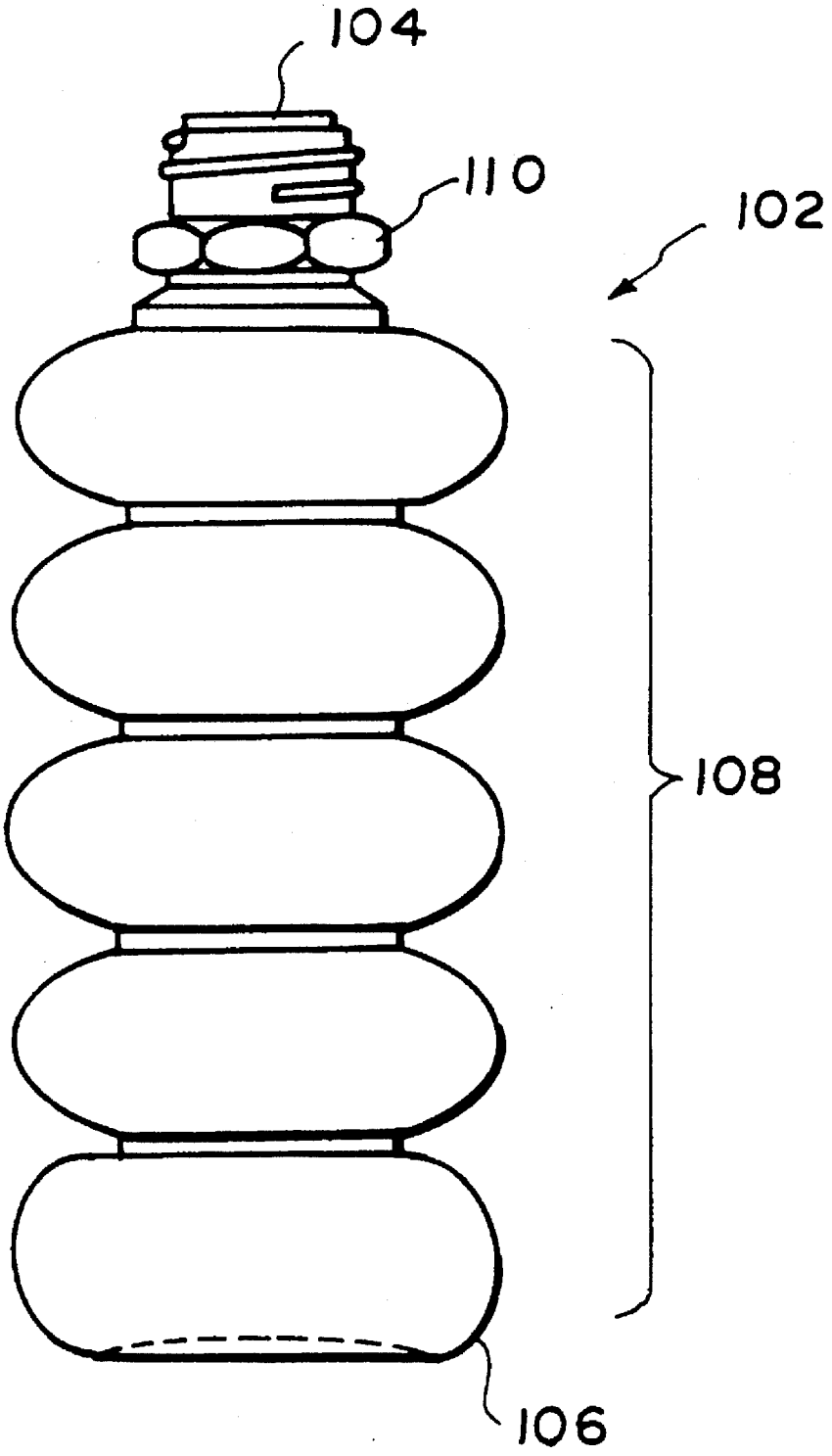
Figure 8:
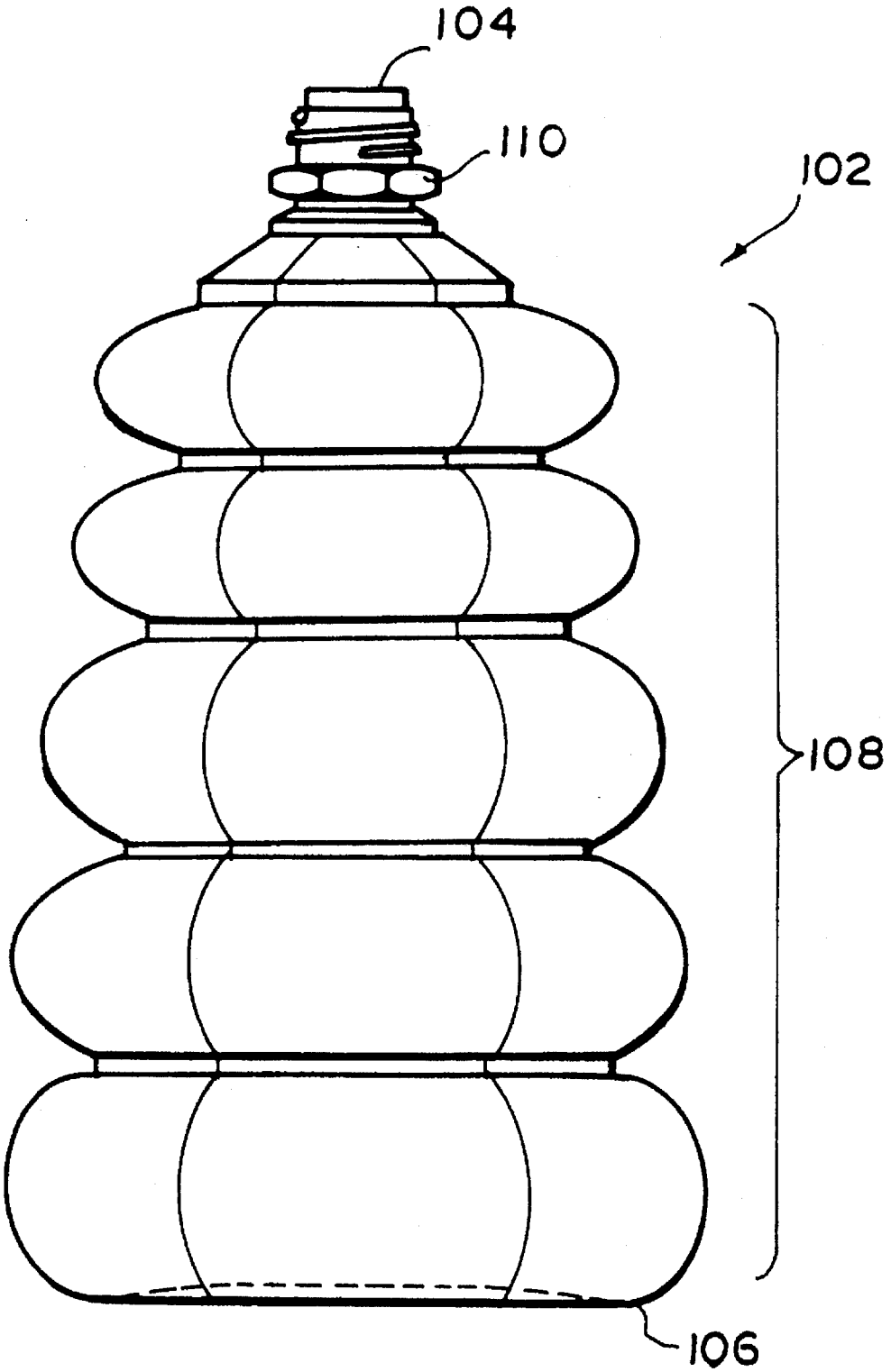

In the embodiment described above, as illustrated in FIG. 4, the container 102 is provided with the pleated expansible part 108. When a vertical tensile load of not smaller than a predetermined value is given to the container 102, which is in the maximum contraction state, the fourth step-like portion 108*d* and the fifth step-like portion 108*e* first expand due to the load. When a larger tensile load is then given to the container 102, the step-like portions expand in the order of the third step-like portion 108*c*→the second step-like portion 108*b*→the first step-like portion 108*a*. However, even if the step-like portions of the pleated expansible part 108 expand in a random order, the effects of the present invention can be obtained. For example, containers 102 having the structures shown in FIGS. 6, 7, and 8 may also be employed. The container 102 shown in FIG. 6 or FIG. 7 is provided with the step-like portions having the same shape. Therefore, in cases where the container 102 shown in FIG. 6 or FIG. 7 is employed, the volume and the height of the container 102 increases by an equal amount each time one of the step-like portion expands. Accordingly, the container 102 shown in FIG. 6 or FIG. 7 is easy to process.

What is claimed is:

1. A method for charging a liquid into a container through a liquid charging opening, which is formed at an upper end of the container, wherein the container comprises a bottom for self-support, which is formed at a lower end of the container and causes the container to be supported by itself, and a pleated expansible part, which is formed at a middle region between the upper end and the lower end of the container and which expands or contracts vertically and causes the volume of the container to change due to at least a predetermined vertical load when the vertical load is applied to the container, the method comprising the steps of:

i) feeding the container toward a liquid charging means, while the container is supported by itself and the pleated expansible part is contracted, and ii) applying at least the predetermined vertical load to the container to cause the pleated expansible part to expand by a predetermined amount while or before the liquid is charged by the liquid charging means into the container.

2. A method as defined in claim 1, wherein, before the liquid is charged by the liquid charging means into the container, the pleated expansible part is caused to expand by introducing a gas into the container to increase the internal pressure of the container.

3. A method as defined in claim 1 wherein, before the liquid is charged by the liquid charging means into the container, the vertical load is given to the container by a mechanical means, which gives a vertical tensile load from the exterior to the container.

4. A method as defined in claim 1 wherein, when the liquid is charged by the liquid charging means into the container, the vertical load is given to the container by utilizing the weight of the liquid having been charged into the container.

5. A method as defined in claim 1 wherein, when the liquid is charged by the liquid charging means into the container, the vertical load is given to the container by utilizing the transfer pressure of the liquid charged into the container.

6. A method as defined in claim 1 wherein, when the liquid is charged by the liquid charging means into the container, the vertical load is given to the container by a mechanical means, which gives a vertical tensile load from the exterior to the container.

* * * * *